US008196303B2

(12) United States Patent
Baron et al.

(10) Patent No.: US 8,196,303 B2
(45) Date of Patent: Jun. 12, 2012

(54) SHAVING APPARATUS AND METHOD OF MANUFACTURING SUCH APPARATUS

(75) Inventors: Sint Baron, Drachten (NL); Pieter Nico Krikken, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1151 days.

(21) Appl. No.: 10/580,620

(22) PCT Filed: Nov. 15, 2004

(86) PCT No.: PCT/IB2004/052419

§ 371 (c)(1),
(2), (4) Date: May 24, 2006

(87) PCT Pub. No.: WO2005/051615

PCT Pub. Date: Jun. 9, 2005

(65) Prior Publication Data

US 2007/0107230 A1 May 17, 2007

(30) Foreign Application Priority Data

Nov. 25, 2003 (EP) ..... 03104365

(51) Int. Cl.
*B26B 19/14* (2006.01)

(52) U.S. Cl. ..... 30/43.6; 30/42; 30/45; 30/50

(58) Field of Classification Search ..... 30/43.6, 30/42, 45, 50

See application file for complete search history.

(56) References Cited

U.S. PATENT DOCUMENTS

| | | | | |
|---|---|---|---|---|
| 3,101,537 | A * | 8/1963 | Kleinman | 30/43.92 |
| 3,103,299 | A | 9/1963 | Werft | |
| 4,719,698 | A * | 1/1988 | Ninomiya et al. | 30/43.6 |
| 5,189,792 | A * | 3/1993 | Otsuka et al. | 30/43.92 |
| 6,430,813 | B2 * | 8/2002 | Muraguchi et al. | 30/43.92 |
| 6,568,083 | B1 * | 5/2003 | Iwasaki et al. | 30/43.2 |
| 6,730,100 | B2 * | 5/2004 | Yamaguchi et al. | 606/133 |

FOREIGN PATENT DOCUMENTS

WO WO 03/068466 8/2003

* cited by examiner

*Primary Examiner* — Lee D Wilson
*Assistant Examiner* — Shantese McDonald

(57) ABSTRACT

A shaving apparatus has one or more shaving heads (5) with a shaving surface (9) for contacting the skin during shaving and at least one cutter (4) that is moveable behind the shaving surface (9). A drive structure (3) including a motor (2) and coupled to the cutter or cutters (4) for driving the movement of the cutter or cutters is carried by a housing (1) containing the motor (2) of the drive structure. A shell structure (12) envelops at least a portion of the housing (1) behind the shaving head or heads (5) and is mounted to the housing (1).

21 Claims, 4 Drawing Sheets

SHAVING APPARATUS AND METHOD OF MANUFACTURING SUCH APPARATUS

The invention relates to a shaving apparatus including at least one shaving head including a shaving surface for contacting the skin during shaving and at least one cutter that is moveable behind the shaving surface, a drive structure including a motor and coupled to the at least one cutter for driving the movement of the at least one cutter, and a housing containing the motor and carrying the drive structure. The invention further relates to a method of manufacturing such shaving apparatuses.

Such a shaver is known from practice, for instance in the form of Philishave shavers of various designs.

Electric shavers are typically used in the bathroom, which is an environment where electrical appliances may easily be damaged, owing to mechanical failure when the apparatus is dropped onto the, typically hard, bathroom floor or owing to the entry of humidity into the housing, in particular if the apparatus is used for wet shaving. Ingress of humidity may also result from damage to the housing.

The visual appearance and tactile properties are further important features of an electric shaver and need to be reconciled in the design of the housing with the aforementioned mechanical requirements. In practice, these mechanical requirements limit the extent to which demands with respect to the visual appearance and tactile properties can be met.

It is an object of the present invention to provide an apparatus in which the visual appearance and tactile properties are less restrained by mechanical requirements of the housing and in which changes in the design with respect to visual appearance and/or tactile properties require less extensive redesign and retooling.

According to the present invention, this object is achieved by providing a shaving apparatus according to claim 1. The invention further provides a method according to claim 15 of manufacturing such apparatuses having mutually different exterior designs.

Since the requirements with respect to shielding of the motor and the power supply means as well as with respect to a support and mutual positioning of the drive structure and the shaving heads are met by the housing, the appearance and tactile properties of the shell structure can be designed without regard to these requirements. New exterior designs of the electric shaver can be generated quickly because the main constructional requirement the shell structure has to meet is that it needs to be mountable to the basic housing. The functional platform formed by the basic housing and the drive structure and shaving heads mounted thereto, that are fully developed and tested to meet functional and safety requirements, can be maintained unchanged. New tools only need to be provided for manufacturing the redesigned shell structure. Another advantage is that the exterior design of shavers is determined at a relatively late stage in production, so that production can respond more rapidly to demands for different shaver models. In production, the selection of the shell structures to be mounted to basic bodies including the housings can be determined at a late stage.

Particular embodiments of the invention are set forth in the dependent claims. Further aspects, effects and details of the invention will be described below with reference to examples shown in the schematic drawings.

Figure 1:
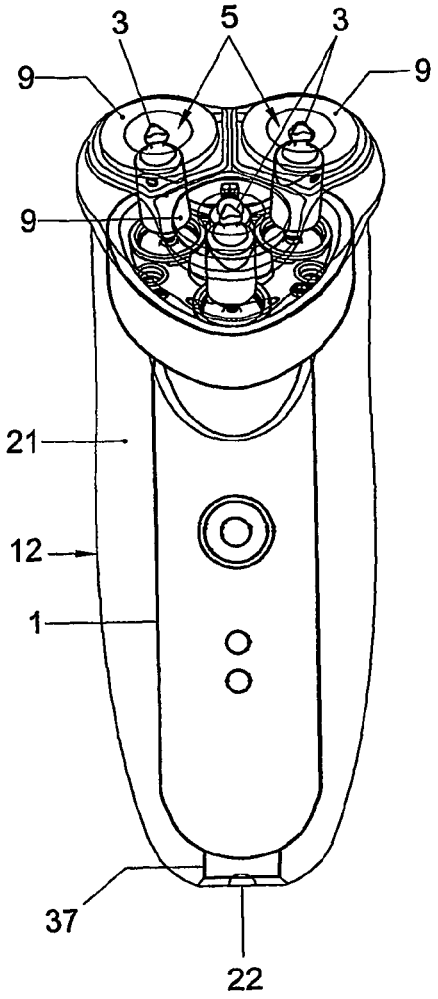
FIG. 1 is a frontal view of a first example of a shaving apparatus according to the invention of which a shell is shown as a transparent housing part.

Reference is first made to an example of an apparatus according to the invention shown in FIGS. 1 to 4.

The apparatus includes a housing 1 and a drive structure including a motor 2 in the housing. The drive structure, of which drive stubs 3 coupling the drive structure to cutters 4 of shaving heads 5 are shown in the drawings, is carried by the housing 1. The shaving heads 5 are suspended in a shaving head holder 8, which according to this example is supported by a shaving head holder support 7.

The shaving heads 5 each have a shaving surface 9 for contacting the skin during shaving and the cutters 4 are each moveable behind the shaving surface 9 for cutting off hairs that project through hair catching apertures (not shown) in a screen that defines the shaving surface 9.

The drive structure is coupled to the cutters 4 for driving the movement of the cutters. According to this example, for the motor 2 is powered by a rechargeable battery 10 and controlled by circuitry 11 connected to a plug socket 37. The power supply formed by the battery 10 and the circuitry are arranged inside the housing 1.

Although the power supply means inside the housing are shown to include a battery and control circuitry, it is observed that the power supply means inside the housing may, for example, consist merely of electrical conductors connected to the motor, for instance if the shaver does not include a battery and the power control circuitry is arranged in a contact plug to be connected to the mains and connected to the motor via a permanently connected power supply cord.

Figure 4:
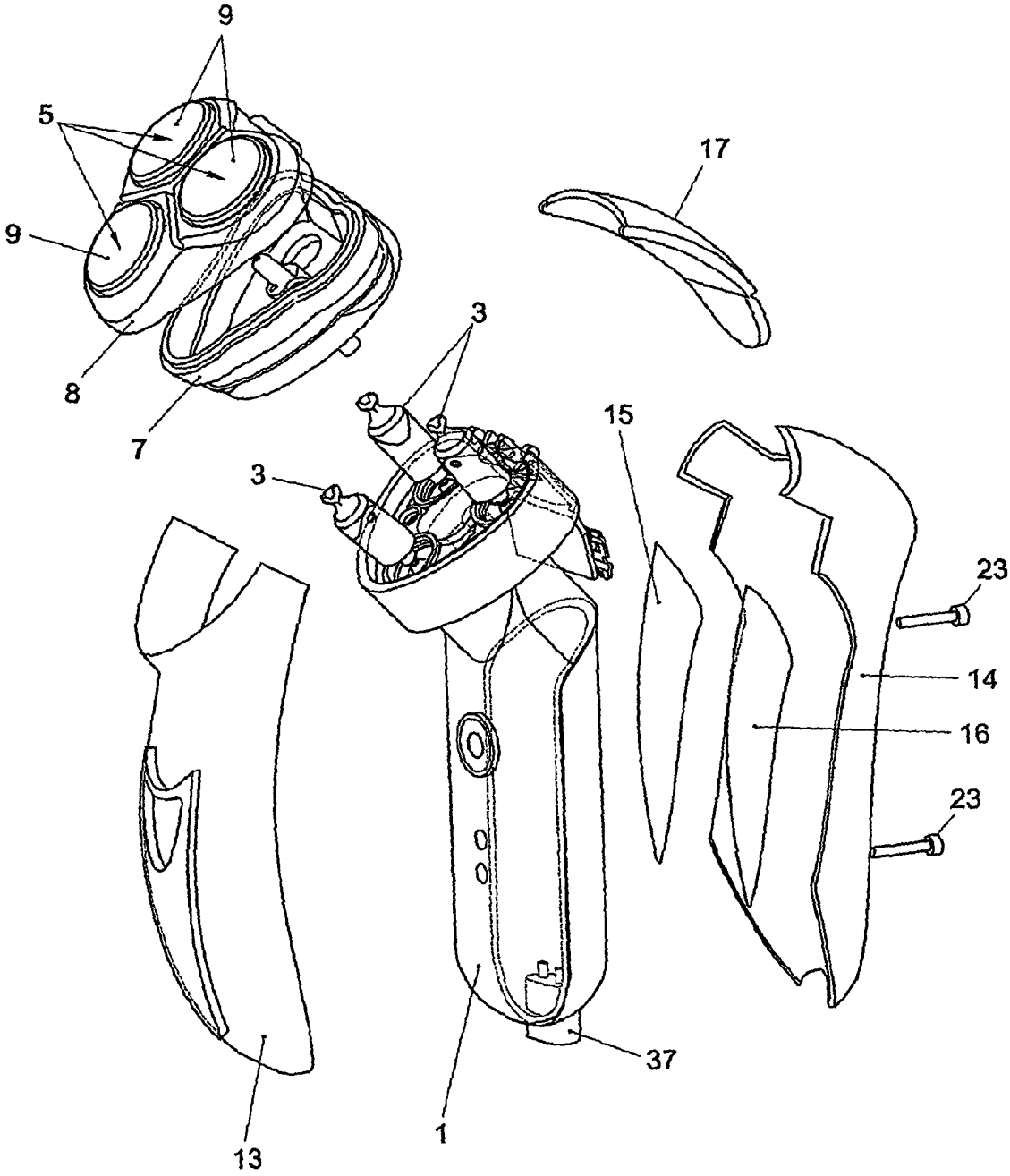
FIG. 4 is an exploded view of the shaver according to FIGS. 1 to 3.

A shell structure 12 envelops a portion of the housing 1 behind the shaving heads 5 and is mounted to the housing 1. As is best seen in FIG. 4, the shell structure consists of a plurality of shell parts, including a front face 13, a rear wall 14, side panels 15, 16, and a trimmer cover 17.

Since the functional requirements of shielding the motor 2 and the power supply 10 and providing a support structure for the drive structure and the shaving heads is fulfilled by the housing 1, the shell structure 12 can be provided in a wide variety of designs and finishes and, in production, the exterior design can be determined at a late stage of production, for instance in response to demand for particular designs or particular indications on the shavers. Also, new exterior designs of the apparatus can be generated quickly, because the only constructional requirement is that the shell need to be mountable to the housing 1, while the functional platform of the housing 1 and the drive structure and shaving heads 5 mounted thereto, that are fully developed and tested to meet functional and safety requirements, can be maintained unchanged.

The shell structure 12 does not envelop the housing completely, e.g. a face against which the shaving head holder support 7 is to be mounted and an opening of the plug socket 37 are not covered. Also other portions of the housing may be left uncovered by the shell structure, for example to allow access to control members, to a battery compartment, and/or to members for engaging a storage and/or cleaning holder, or to leave surface portions of the housing selectively exposed. However, it is understood that the enveloping shell covers at least major portions of the surface of the housing on opposite sides of the housing so that it substantially determines the exterior design and tactile properties of the shaver.

In the present example, the shell structure 12 extends from a face against which the shaving head holder support 7 carrying the shaving head holder 8 to which the shaving heads are mounted 5 to a power plug socket 37 at an end of the housing 1 opposite from the face against which the shaving head holder support 7 is mounted. Thus, the shielding of the housing extends over substantially the entire distance between the extreme ends of the housing 1, so that the housing is effectively protected and a large freedom of design with respect to the ergonomic design and aesthetic outer appearance of the apparatus is available, without requiring changes to the design of the basic housing 1.

Protection of the housing and individuality of design of different apparatuses based on the same basic housing 1 is further enhanced, because the shell structure 12 fully envelopes the housing 1 between the face against which the shaving head holder support 7 is mounted and the power plug socket 37.

According to the present example, the housing 1 is waterproof, for which purpose housing portions 18, 19 are mounted to each other with a seal 20 between them. Since the exterior shape of the shaver is determined by the shell structure 12, the stiffness of the housing 1 along its seams, which is required to keep it reliably waterproof, is not compromised by demands with respect to exterior design and tactile properties. For instance, outer reinforcements of the housing 1 and sinks in the outer surface of the housing 1 resulting from internal ribs may be allowed without disturbing the appearance of the shaver after the shell structure has been mounted. Furthermore, wide seams, even of different and varying widths, and a relatively large seal 20 may be provided without disturbing the visual appearance of the apparatus, because the seams and the seal 20 are hidden behind the shell 12.

Figure 2:
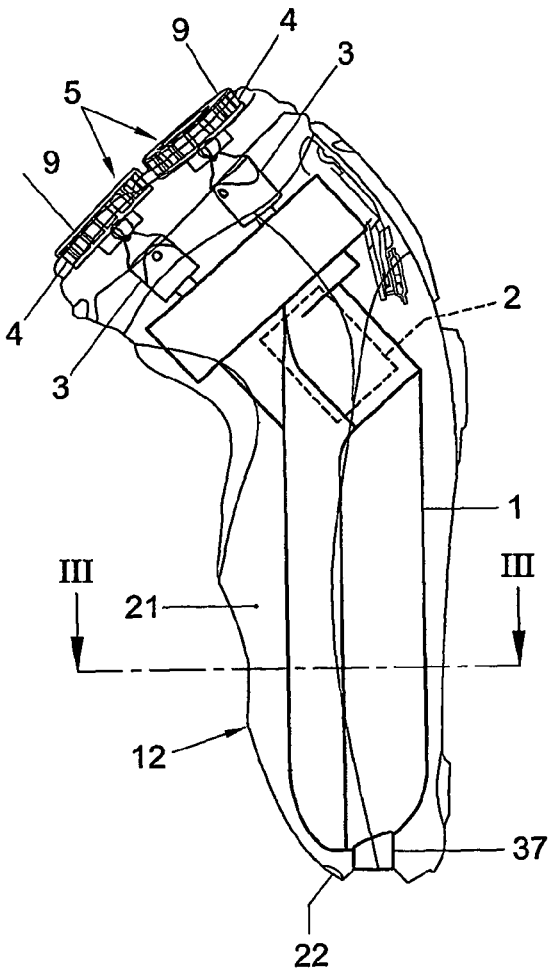
FIG. 2 is a side view of the shaver according to FIG. 1.
Figure 3:
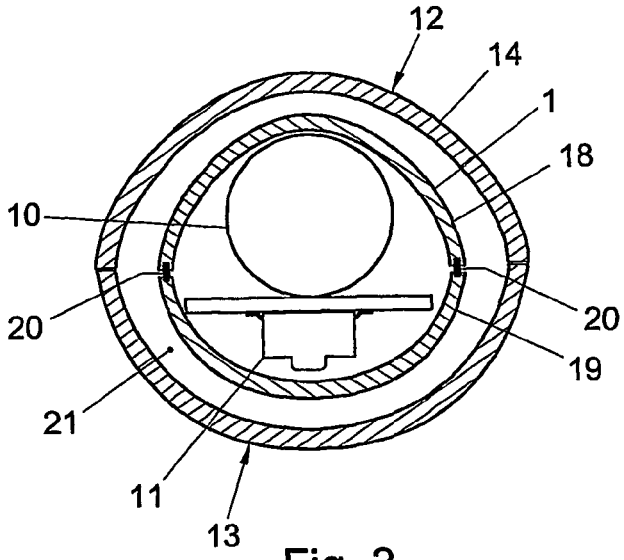
FIG. 3 is a cross-sectional view taken on the line III-III in FIG. 2.

As is best seen in FIGS. 1 to 3, the shell structure 12 includes shell portions that are spaced from the housing 1, such that an interspace 21 is left between the housing 1 and said shell portions. The interspace allows deformation of the shell portions spaced from the housing 1, without hitting the housing 1, so that major deformations of the shell 12 are allowable and accordingly large amounts of impact energy can be absorbed relatively smoothly. Thus the shell 12 may also contribute to shielding the housing 1 from direct impacts. It is also advantageous for this purpose if the shell is made of impact-absorbing materials, such as relatively soft plastics.

Another advantage of the presence of an interspace 21 between the housing and portions of the shell 12 is that water can easily be drained from between the housing 1 and the shell 12, in particular if one or more draining passages 22 are provided for draining the interspace 21 between the housing 1 and the shell 12.

The provision of a shell 12 around the housing 1 further allows the materials of the housing 1, which needs to rigidly support the drive structure and the shaving heads 5 rigidly, and of the shell 12, which needs to be capable of withstanding shocks and to be; pleasant to touch, to be specifically selected in accordance with their respective functions. For example, at least one portion of the shell 12 may be of a more impact-resistant material and/or softer material than the housing 1. The shell structure may comprise, for example, metal, rubber, wood, leather, textile, or transparent, opaque, and/or foam material. Also the surface texture and surface finish of the shell structure 12 may be selected without regard to mechanical requirements to be fulfilled by the housing 1. The use of a shell structure enveloping the housing also allows the use of transparent or opaque components that are coated on the inside, to counteract damage to the coating and to obtain a particular visual effect.

The shell 12 is mounted to the housing 1 by a combination of bolts 23 and snap connections, such that the shell 12 is detachable from the housing 1. This makes it easy to replace any damaged or worn shell portions. Since a removal of the shell 12 does not provide the user access to the interior of the housing, replacement of shell portions can safely be carried out as a do-it-yourself operation by unskilled consumers and also allows the user to change the appearance of the apparatus, for example to match the bathroom design.

Figure 5:
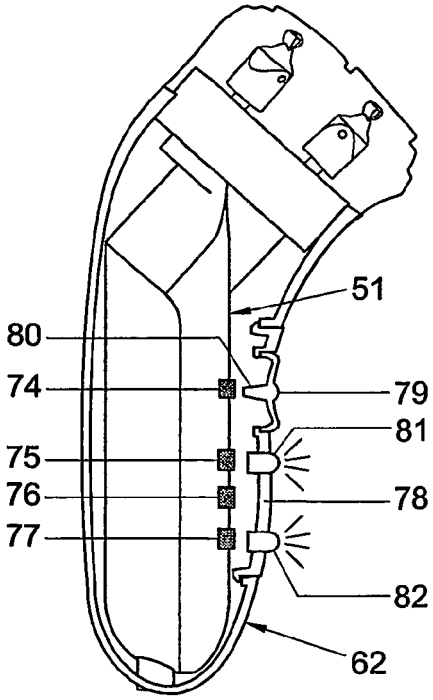
FIG. 5 is a cut-away side view of a second example of a shaving apparatus according to the invention.
Figure 6:
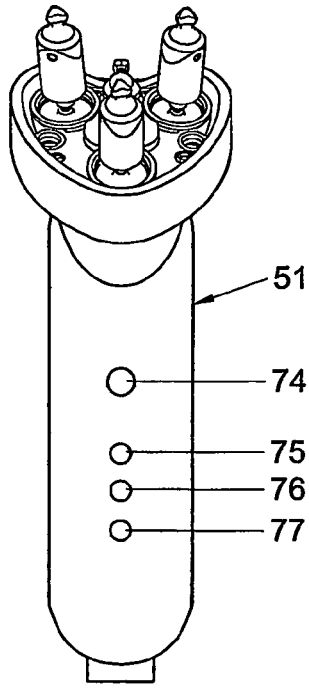
FIG. 6 is a frontal view of the housing and a portion of the drive structure of the shaving apparatus according to FIG. 5.

FIGS. 5 and 6 are illustrations of an example of a shaving apparatus according to the invention in which the housing 51 comprise a first operating member 74 in the form of an on/off button. The shell 62 includes a panel 78 that carries a second operating member in the form of a rubber push button membrane 79 of which a protrusion 80 is operatively connected to the first operating member 74 for mechanically operating the on/off button if the rubber push button 79 is pushed. Thus, operating members on the housing 51 can be operated by actuating connected operating members of the shell 12.

The housing 51 further comprises three optical signaling members in the form of differently colored LEDs 75, 76, 77. The shell 62 includes two windows 81, 82 in the form of optical waveguides via which optical signals generated by two of the LEDs are visible. The control system of the shaver may be arranged, for example, such that the central LED 78 is not operative in the shown model. The user is only confronted with waveguides 81, 82 in front of the operative LEDs and is not led to think that the central LED is defective, even if the same housing 51 is used for a model comprising a smaller number of operational LEDs, or LED positions than the number of LEDs in the housing 51.

Figure 7:
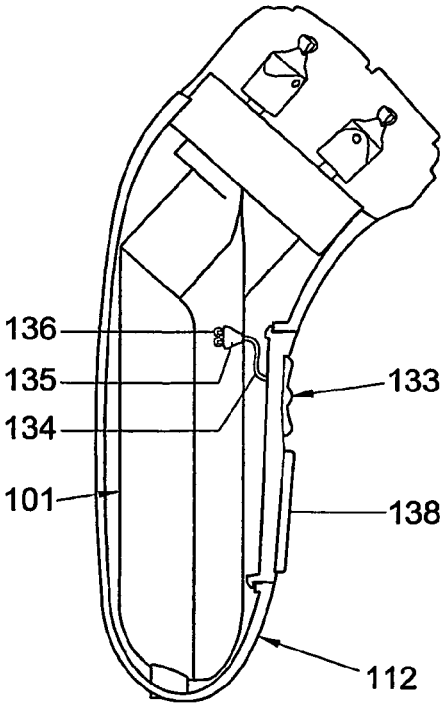
FIG. 7 is a cut-away side view of a third example of a shaving apparatus according to the invention.
Figure 8:
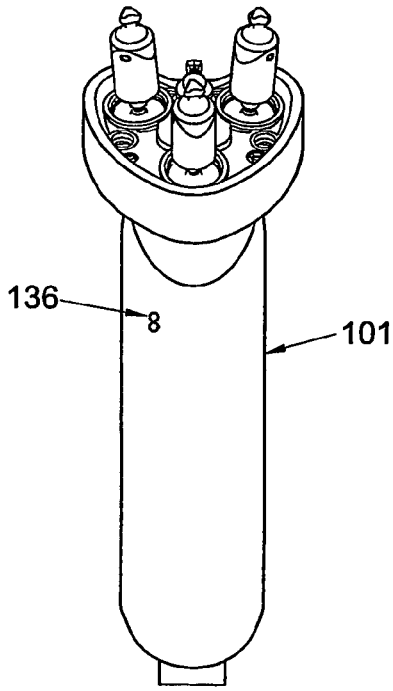
FIG. 8 is a frontal view of the housing and a portion of the drive structure of the shaving apparatus according to FIG. 7.

FIGS. 7 and 8 show yet another example of a shaving apparatus according to the invention, in which an operating member 133 on the shell 112 is electrically (instead of mechanically) connected to an operating member in the housing 101. To this end, the operating member 133 on the shell 112 is formed by a switch. The shell is also provided with a display 138. According to this example, the display is an LCD display. The position of the display 138 integrated in the shell structure 112 provides the advantage that the display is completely visible from a wide range of angles. An electric cable 134 is connected to the switch 133 and the display 138. The electric cable is provided with a plug 135 connected to a plug socket 136 in the housing 101.

Figure 9:
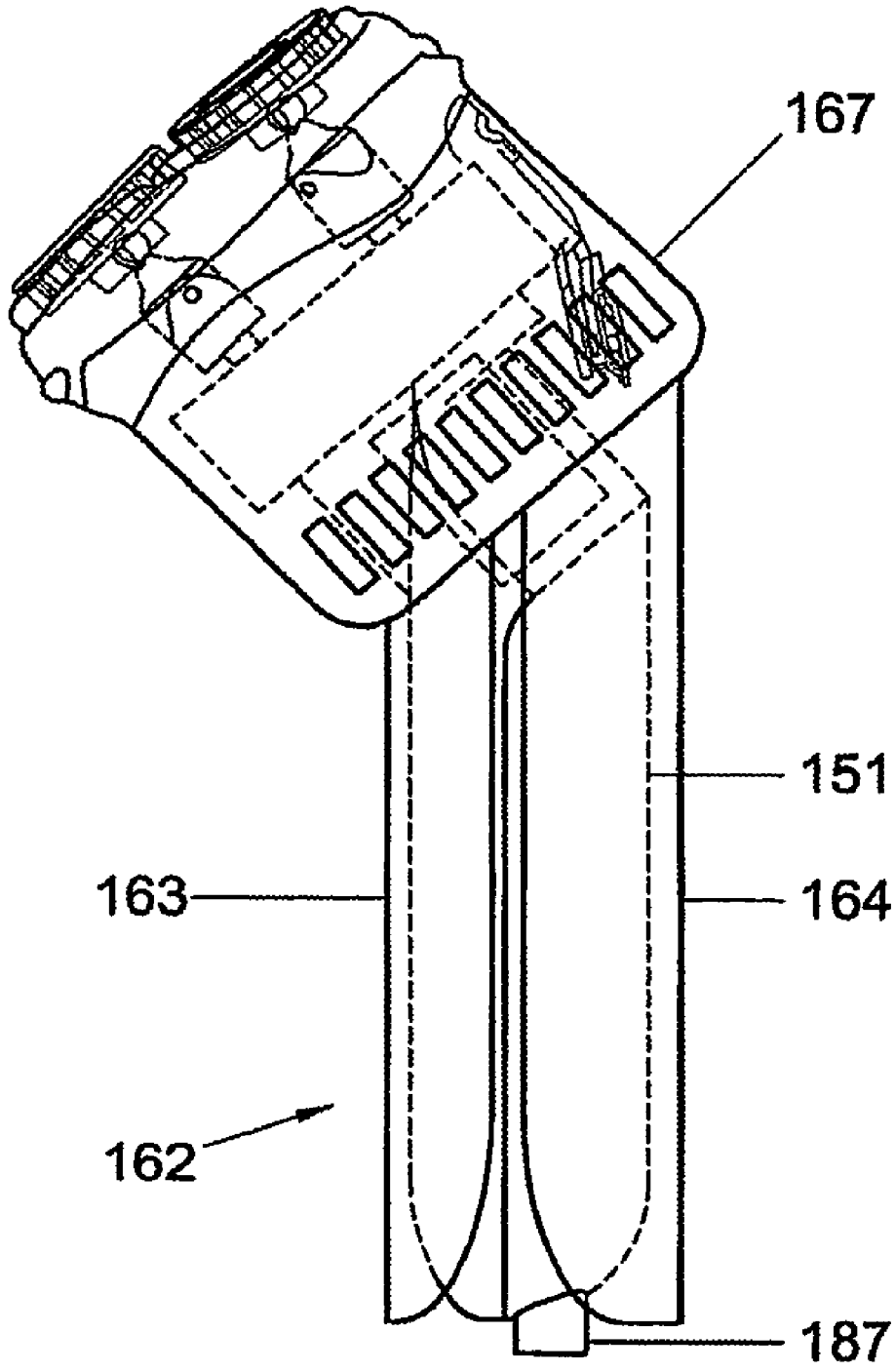
FIG. 9 is a side view of a fourth example of a shaving apparatus according to the invention.

In FIG. 9, an example of an apparatus according to the invention in which also portions of the housing 151 between the power plug socket 187 and the shaving head holder support are left uncovered by the shell structure 162 is shown. The shell structure includes shell members 163, 164 between which is slit is left when the shell members 163, 164 are mounted to the housing 151. Through the slit, the basic housing 151 is visible. A further shell member 167 surrounds a portion of the basic housing adjacent the shaving head holder support.

Having described the invention with reference to examples, however, many modifications thereto will become apparent to those skilled in the art without deviating from the scope of the invention as defined in the appended claims.

The invention claimed is:

1. A shaving apparatus comprising:

a head holder having at least one shaving head including a shaving surface for contacting the skin during shaving, and at least one cutter moveable behind the shaving surface;

a housing having first and second ends carrying a drive structure at the first end, and for enclosing a motor coupled to the drive structure for driving the at least one cutter and at least part of an electric power supply connected to the motor, the electric power supply having a power plug socket at the second end; and a shell structure extending at least from the head holder to the power plug socket for enveloping the housing and forming an interspace and at least one draining passage adjacent the housing.

2. The shaving apparatus according to claim 1, wherein the shell structure includes shell portions spaced from the housing such that the interspace is left between the housing and said shell portions.

3. The shaving apparatus according to claim 2, wherein the at least one draining passage is formed for draining the interspace between the housing and the shell structure.

4. The shaving apparatus according to claim 1, wherein at least a portion of the shell structure is of a more impact resistant material than the housing.

5. The shaving apparatus according to claim 1, wherein at least a portion of the shell structure is of a softer material than the housing.

6. The shaving apparatus according to claim 1, wherein the housing includes at least one operating member and the shell structure includes at least one manipulating member operatively connected with said operating member.

7. The shaving apparatus according to claim 6, wherein said manipulating member is mechanically connected with said operating member.

8. The shaving apparatus according to claim 6, wherein said manipulating member is electrically connected with said operating member.

9. The shaving apparatus according to claim 1, wherein the housing includes at least one optical signaling member, and said shell structure including a window via which optical signals generated by said optical signaling member are visible.

10. The shaving apparatus according to claim 1, wherein the shell structure is detachable from the housing.

11. The shaving apparatus according to claim 1, wherein the shell structure is selected from a plurality of different shapes.

12. The shaving apparatus according to claim 11, wherein said shell structures having different shapes are alternatively mountable on said housing and cover the same portions of said housing.

13. The shaving apparatus according to claim 1, wherein the electric power supply includes a battery and the housing fully encloses the battery between the first and second ends.

14. The shaving apparatus according to claim 1, wherein the electric power supply includes a battery and wherein the housing fully encloses the battery and the motor between the first and second ends.

15. The shaving apparatus according to claim 1, wherein the electric power supply includes a battery and control circuitry and wherein the housing fully encloses the battery and the control circuitry between the first and second ends.

16. The shaving apparatus according to claim 1, wherein the housing is waterproof between the face and the power plug socket such that water can not enter the space.

17. A method of manufacturing a shaving apparatus, comprising a head holder having at least one shaving head including a shaving surface for contacting the skin during shaving and at least one cutter moveable behind the shaving surface, the method comprising acts of:

manufacturing a housing having first and second ends for carrying a drive structure at the first end and for enclosing a motor coupled to the drive structure for driving the at least one cutter and at least part of an electric power supply connected to the motor, the electric power supply having a power plug socket at the second end; and manufacturing a shell structure for enveloping the housing and forming an interspace and at least one draining passage between the housing and said shell structure, wherein the shell structure extends at least from the head holder to the power plug socket fully enclosing the housing.

18. The method according to claim 17, further comprising an act of manufacturing at least one draining passage for draining the interspace between the housing and the shell structure.

19. The method according to claim 17, wherein the electric power supply includes a battery and wherein the act of manufacturing the housing comprises an act of manufacturing the housing to fully enclose the battery between the first and second ends.

20. The method according to claim 17, wherein the act of manufacturing the housing comprises an act of manufacturing the housing to be waterproof between the face and the power plug socket such that water can not enter the space.

21. A method of providing a shaving apparatus, comprising a head holder having at least one shaving head including a shaving surface for contacting the skin during shaving and at least one cutter moveable behind the shaving surface, the method comprising acts of:

providing a housing having first and second ends for carrying a drive structure at the first end, and enclosing a motor coupled to the drive structure for driving the at least one cutter and at least part of an electric power supply connected to the motor, the electric power supply having a power plug socket at the second end; and providing a shell structure for enveloping the housing and forming an interspace and at least one draining passage between the housing and said shell structure, wherein the shell structure extends at least from the head holder to the power plug socket fully enclosing the housing.

* * * * *